United States Patent [19]

Buan et al.

[11] 3,996,428

[45] Dec. 7, 1976

[54] PUSHBUTTON KEYBOARD ASSEMBLY WITH OVER CENTER DIAPHRAGM CONTACT

[75] Inventors: Danilo P. Buan, Fremont; Richard F. Kingsbury, San Jose, both of Calif.

[73] Assignee: Litronix, Inc., Cupertino, Calif.

[22] Filed: Mar. 17, 1975

[21] Appl. No.: 558,585

[52] U.S. Cl. ..... 200/5 A; 200/159 B; 200/275; 200/302

[51] Int. Cl.[2] ..... H01H 13/70; H01H 1/06

[58] Field of Search ..... 200/5 R, 5 A, 159 B, 200/1 R, 159 A, 275, 294–296, 302

[56] References Cited

UNITED STATES PATENTS

| | | | |
|---|---|---|---|
| 3,684,842 | 8/1972 | Boulanger | 200/5 A UX |
| 3,745,287 | 7/1973 | Walker | 200/159 B |
| 3,749,859 | 7/1973 | Webb et al. | 200/5 A X |
| 3,783,205 | 1/1974 | Boulanger | 200/5 A |
| 3,806,673 | 4/1974 | Boulanger | 200/5 A |
| 3,811,025 | 5/1974 | Bach | 200/5 A X |
| 3,849,611 | 11/1974 | Walker, Jr. | 200/275 X |
| 3,854,018 | 12/1974 | Reynolds et al. | 200/5 A |
| 3,928,736 | 12/1975 | Drage | 200/275 X |
| 3,941,953 | 3/1976 | Misson et al. | 200/159 B X |

*Primary Examiner*—James R. Scott
*Attorney, Agent, or Firm*—Townsend and Townsend

[57] ABSTRACT

A switch assembly having a plurality of movable elements for connection with underlying fixed contact elements carried by a base member, the movable insulative support sheet mounted on the base member. Each movable element is spaced by an electrically insulative sheet carried by the support sheet, and has a pair of opposed tines extending through the support sheet received in base member apertures. The movable elements may be dome shaped, partially cylindrical in shape, and span a plurality of the fixed contact elements.

19 Claims, 17 Drawing Figures

PUSHBUTTON KEYBOARD ASSEMBLY WITH OVER CENTER DIAPHRAGM CONTACT

BACKGROUND OF THE INVENTION

This invention relates to electrical keyboards of the type having a plurality of manually actuatable pushbutton switches. More particularly, this invention relates to electrical pushbutton keyboards of the type having a plurality of overcenter diaphragm contacts.

With the increasing trend towards miniaturization of electronic calculators, computers, terminals and other devices, there is a corresponding increasing demand for miniaturized keyboard entry devices which are low in fabrication cost, highly reliable in operation, rugged in construction, and which provide proper operator touch or feel. Recent efforts in this area of keyboard design have been directed to pushbutton keyboard switch assemblies employing overcenter diaphragm contacts.

Keyboards are known which include a plurality of manually actuatable pushbutton members for enabling data entry into an associated electronic device, such as a calculator or a computer. As illustrated in U.S. Pat. Nos. 3,749,859 and 3,684,842, in typical keyboards of this type, each pushbutton is provided with an associated underlying movable curved diaphragm contact element, an associated fixed contact element and a common conductor plane to which each diaphragm contact element is electrically connected. Upon actuation of a given pushbutton, the movable curved contact element is deformed in such a way as to make contact with the fixed contact element, thereby closing an electrical circuit. Upon subsequent release of the pushbutton, the pushbutton is biased in the opposite direction to the normal non-actuated state by the spring-like action of the curved contact element alone or in combination with a separate bias spring.

Known keyboard designs using diaphragm contacts suffer from several disadvantages. Some keyboards, while miniaturized to a convenient size, employ a relatively large number of working parts and are thus relatively expensive to fabricate and prone to early failure. Others do not provide proper operator touch or feel. Still other keyboard designs are compatible with only a relatively small number of keyboard pushbutton patterns, are limited in the number of functional pushbuttons which can be accommodated, and are compatible with only a relatively small number of electrical switching circuit arrangements.

SUMMARY OF THE INVENTION

The invention comprises a pushbutton keyboard switch assembly employing a plurality of movable diaphragm contact elements and which is extremely inexpensive to fabricate, highly reliable in operation, affords optimal operator touch or feel which can be individually tailored to the requirement of a particular application and which is compatible with a wide variety of keyboard patterns and electrical switching circuit arrangements.

In a first embodiment, a plurality of pushbuttons are received in a matrix aperture forming the top cover of the keyboard in operative relation to a corresponding plurality of movable dome shaped diaphragm contact elements mounted there-below, each pushbutton having a downwardly extending central spindle for operating an underlying associated diaphragm contact element. The individual diaphragm contact elements are carried by an apertured electrically insulative support sheet with lower edge portions of the diaphragm contact members resting on the upper surface of the sheet. The support sheet is carried by an insulative base member provided with a plurality of fixed contact elements arranged in a corresponding pattern to the diaphragm contact elements so that contact is established with a corresponding diaphragm contact element in response to the actuation of a pushbutton. The diaphragm contact elements are each provided with a pair of tines extending for a first portion of their individual lengths in opposite directions from the lower periphery of the diaphragm contact element and deformed downwardly for the remainder of their individual lengths to pass through apertures in the insulative base member to establish electrical connection with the associated calculator circuitry. A flexible resilient sheet is positioned between the tops of the diaphragm contact elements and the lower surface of each pushbutton to form a dust and moisture seal therebetween. Proper spacing between the pushbutton spindles and the diaphragm contact elements is afforded by a spacing member which alternately comprises a downwardly projecting peripheral portion of the top cover or a separate electrically insulative sheet carried by the support sheet. The spacer sheet is optionally provided with apertures corresponding to the peripheral outline of the individual diaphragm contact elements to provide lateral restraint therefor.

In an alternate embodiment of the invention, the individual diaphragm contact elements are formed to a partially cylindrical shape and provided with individual crimped-edge portions in order to provide improved snap-action.

In still another embodiment of the invention, the individual diaphragm contact elements each comprise an elongated partially cylindrically shaped member overlying a plurality of fixed contacts and having a single pair of electrical connecting tines extending from opposite ends thereof and downwardly through the insulative base member.

For a fuller understanding of the nature and advantages of the invention, reference should be had to the ensuing detailed description taken in conjunction with the accompanying drawings.

BRIEF DESCRIPTION OF THE DRAWINGS

FIG. 7 is a partial sectional view taken along lines 7—7 of FIG. 6 with one pushbutton depressed;

FIG. 17 is a partial sectional view taken along lines 17—17 of FIG. 15 with one pushbutton depressed.

DESCRIPTION OF THE PREFERRED EMBODIMENTS

Figure 1:
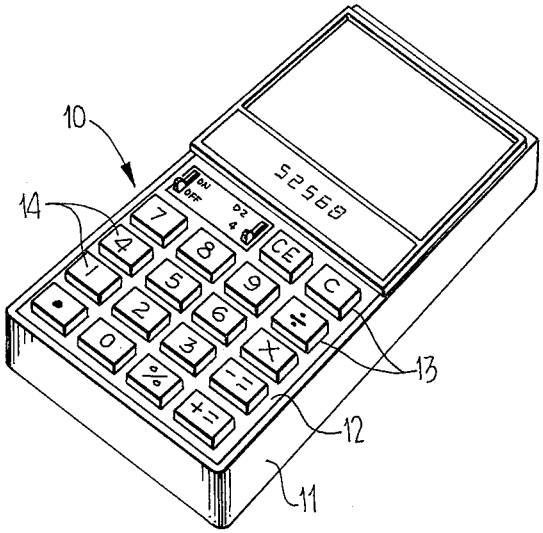
FIG. 1 is a perspective view of a hand held calculator embodying the invention.

Turning now to the drawings, FIG. 1 is a perspective view of a hand held calculator embodying the invention. As seen in this figure, calculator 10 includes a base member 11 and a top cover member 12 provided with a plurality of apertures 13 sized to accommodate a corresponding plurality of conformably configured numeric and function pushbuttons 14.

Figure 2:
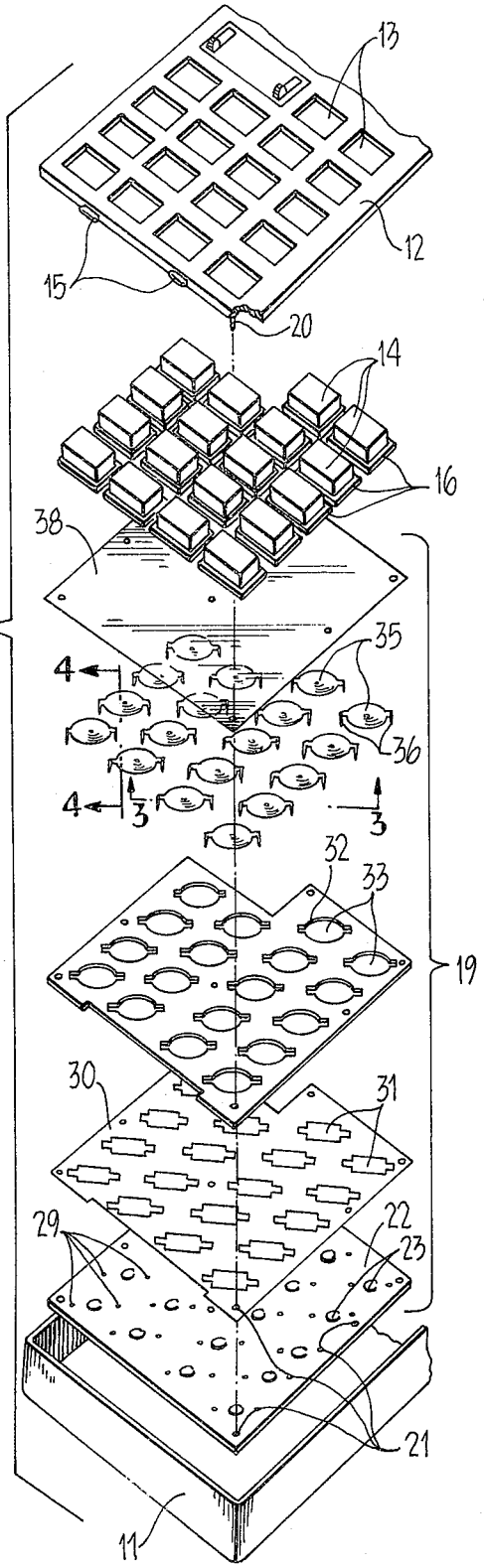
FIG. 2 is an exploded perspective view of a first embodiment of the invention.

With reference to the embodiment shown in FIG. 2, each end of cover member 12 is provided with a pair of locking tabs 15 each engageable with a corresponding locking slot (not shown) in base member 11 to facilitate installation of cover member 12 therein. Pushbuttons 12 are provided with lower flange portions 16 extending peripherally thereof for providing a limit stop in the upward direction of motion, and a central spindle 17 for actuating the associated movable diaphragm contact element described below. Pushbuttons 14 are normally held in their upward non-actuated position illustrated in FIG. 1 by a sandwich-like construction generally designated by reference numeral 19 which is attached to the under surface of cover member 12 by a plurality of downwardly projecting heat stakes 20 integrally formed in cover member 12 and passing through aligned apertures 21 in the various elements comprising construction 19.

Figure 3:
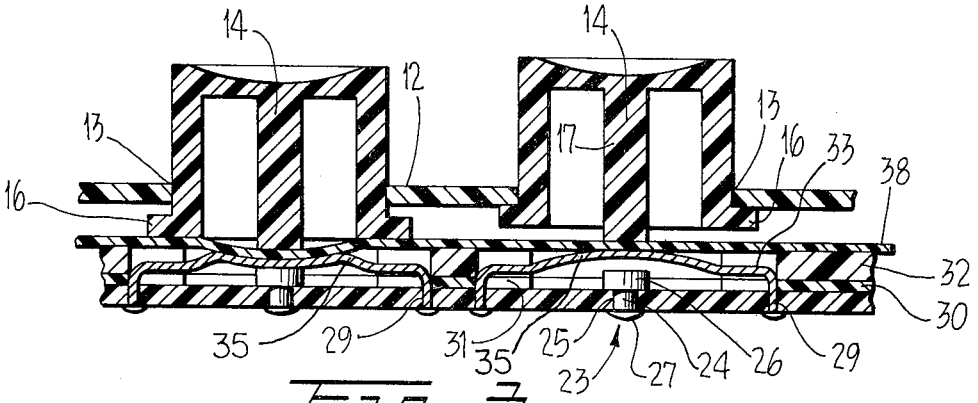
FIG. 3 is a partial sectional view taken along lines 3—3 of FIG. 2 with one pushbutton depressed.
Figure 4:
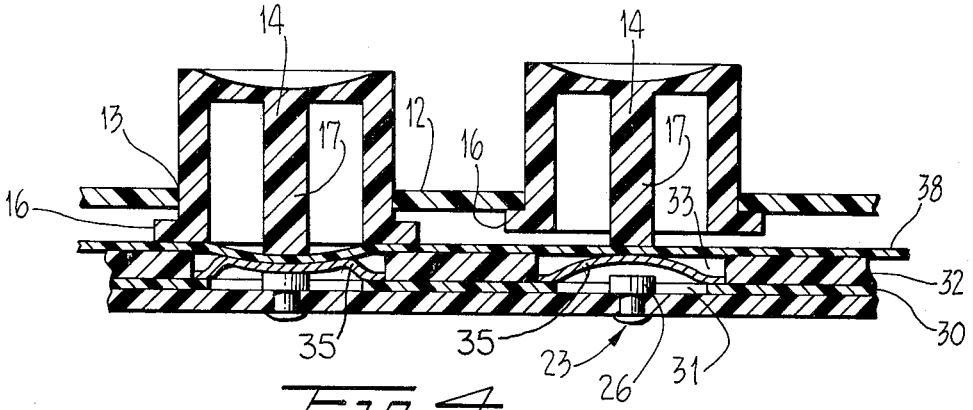
FIG. 4 is a partial sectional view taken along lines 4—4 of FIG. 2 with one pushbutton depressed.
Figure 2:
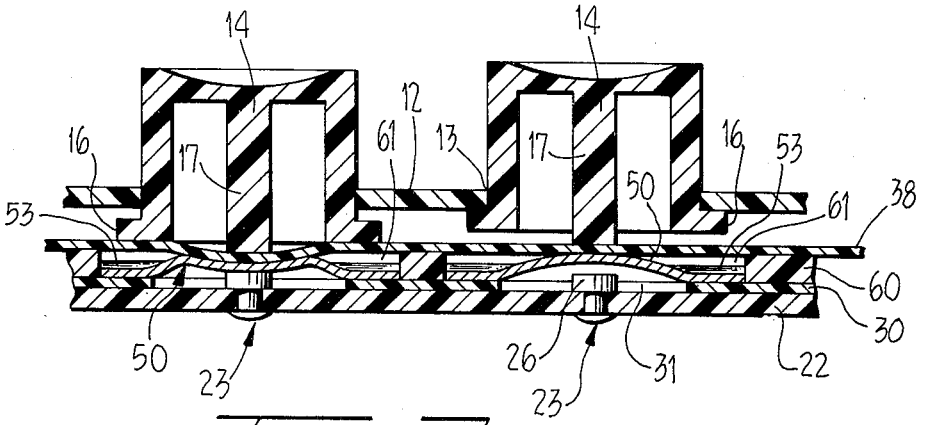

Assembly 19 includes an insulative base member 22 fabricated from glass epoxy or other material exhibiting good electrical insulative properties. Base member 22 is provided with an array of fixed contact elements 23 arranged in a predetermined pattern. As best shown in FIGS. 3 and 4, each fixed contact element 23 has a central portion 24 received in an aperture 25 in base member 22 and a pair of enlarged end portions 26, 27 for immovably securing contact element 23 to base member 22. As further described below, upper end portion 26 also provides an electrical contact surface for switch actuation. Fixed contact elements 23 are preferably fabricated from gold flashed nickel plated copper, Kovar or other relatively non-corrosive materials having good electrical conducting properties. Base member 22 is also provided with a plurality of through-the-board apertures 21 for mounting purposes and apertures 29 for a purpose to be described.

Recevied on the upper surface of base member 22 is a diaphragm contact support sheet 30 having a plurality of apertures 31 configured as shown for a purpose described below. Support sheet 30 is fabricated from Mylar or other equivalent electrically insulative materials known to those skilled in the art.

Received on the upper surface of insulative support sheet 30 is a diaphragm contact retaining sheet 32 having a plurality of apertures 33 configured as shown and overlying apertures 31 in support sheet 30. Retaining sheet 32 is preferably fabricated from fish paper, Mylar or a suitable equivalent material having good electrical insulative properties.

Partially received within apertures 33 of retaining sheet 32 are a plurality of diaphragm contact element 35. Each contact element 35 has a central dome-shaped body portion and a pair of electrical connector tines 36 integrally formed with the body portion at opposing peripheral edges thereof. As best shown in FIGS. 2 and 3, tines 36 extend laterally outwardly a short distance from the periphery of the main body portion of contact element 35 and are bent downwardly to extend through apertures 29 in base member 22. The free ends of tines 36 are soldered to predetermined conductors (not shown) which are arranged along the under surface of base member 22 in a conventional manner. It should be noted that each diaphragm contact element 35 is physically supported by the upper surface of support sheet 30 (FIG. 4) and restrained against lateral motion by apertures 33 in retaining sheet 32. Tines 36 provide no mechanical support for elements 35 but provide electrical connection only.

Overlying the upper surfaces of contact elements 35 is a flexible protective sheet 38, preferably transparent, fabricated from Mylar or other material affording flexibility and dust shielding for the elements lying therebelow.

With reference to FIGS. 2—4, individual contact elements 35 are received in different ones of apertures 33 in retaining sheet 32, the edge walls of the apertures 33 functioning as retaining surfaces to limit lateral motion of the contact element 35 received therein. Portions of the lower edges of each contact element 35 rest on the upper surface of support sheet 30 and for this purpose the lateral dimension of each aperture 31 (i.e. the narrower of the two major dimensions) is made less than the diameter of each diaphragm contact element 35.

Figure 5:
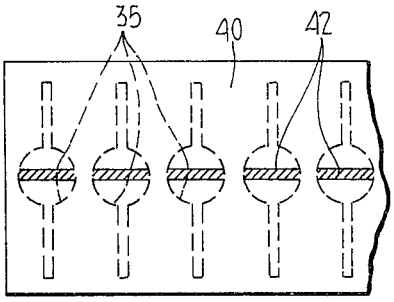
FIG. 5 is a partial top plan view of sheet stock for forming the individual diaphragm contact elements.
Figure 9:
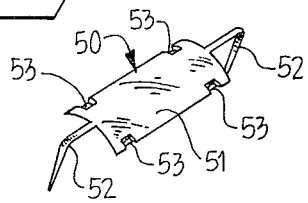
FIG. 9 is a perspective view of an individual diaphragm contact element of the embodiment of FIG. 6.
Figure 6:
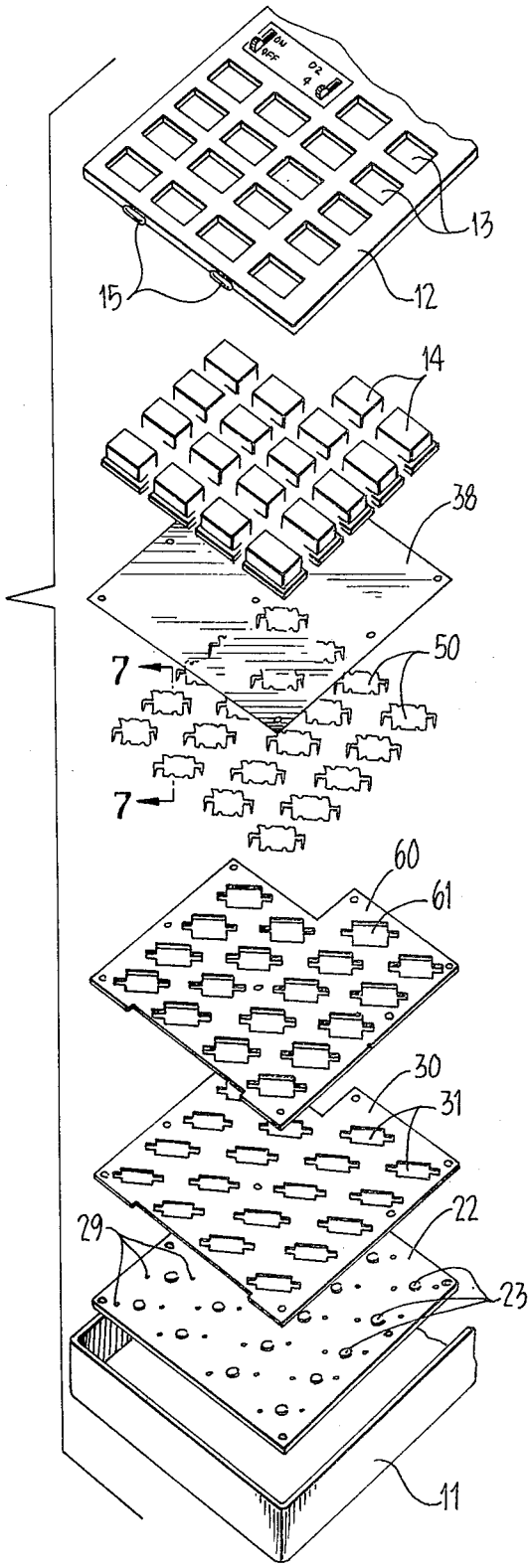
FIG. 6 is an exploded perspective view of an alternate embodiment of the invention.

With reference to FIG. 5, diaphragm contact elements 35 are fabricated by stamping out blanks having the shape indicated by the dotted lines from a sheet of flat stock material 40, forming the central body portion into the dome shape illustrated and bending the tines at substantially right angles at locations therealong conformable with the spacing between paired apertures 29 in base member 22 so that the bent portion of the tines 36 may be readily inserted thereinto. As will be appreciated by those skilled in the art, this process lends itself to mass production at extremely low cost. The diaphragm contact members are preferably fabricated from beryllium copper or other sheet stock material which has spring-like properties and which can be soldered or plated with a relatively noncorrosive material having good electrical conducting properties. In the preferred embodiment, the beryllium copper is first plated with a thin nickel layer and then overplated with gold to a thickness of about 0.00015 inches. As indicated by shaded regions 42, both plating layers are restricted to a width substantially equal to the width of the head portion of fixed contact element 23. The snap action force provided by the domes lies in the range from about 5.5 to about 7.0 ounces and can be readily adjusted by altering the curvature of the dome, and the composition and thickness of sheet stock 40.

To assemble, base memeber 22 is first provided with apertures 21, 25, 29 and fixed contact elements 23 are installed in apertures 25. Support sheet 30 and retaining sheet 32 are next arranged over base member 22 and tines 36 of the individual diaphragm contact elements 35 are inserted through the appropriate apertures 29 and soldered to conductive paths (not shown) arranged along the bottom surface of base member 22 so that the central portion of each diaphragm contact element 35 overlies a different one of fixed contact elements 23. Protective sheet 38 is then placed over the upper surface of diaphragm contact elements 35 and retaining sheet 32, after which pushbuttons 14 are inserted into their respective apertures 13 in cover member 12. Heat stakes 20 are next passed through mounting apertures 21 and heated to enlarge the free ends thereof, thereby forming rivet-like fasteners for securing construction 19 to top cover member 12.

To facilitate assembly, the under surface of support sheet 30 and both the top and bottom surfaces of retaining sheet 32 may be initially provided with an adhesive to temporarily hold the individual elements in their proper positions. Lastly, top cover member 12 is installed in base member 11 of calculator 10.

In operation, when a pushbutton 14 is depressed by an operator, central spindle 17 forces the central body portion of the associated diaphragm contact element 35 downwardly until the under surface thereof makes contact with the upper surface of head portion 26 of the underlying fixed contact element 23. In the course of downward travel of the central dome portion, the diaphragm contact element 35 initially presents a resistive force of increasing magnitude to the operator until an overcenter intermediate position is achieved, after which the resistive force breaks away with increasing deflection in a downward direction. This produces a break away touch or feel to the operator which is highly desirable. Upon release of pushbutton 14, the energy stored in diaphragm contact element 35 due to the flexing thereof is released and the diaphragm contact element 35 snaps back to the rest or non-actuated position, thereby raising the pushbutton 14 to the unactuated position. Flange 16 limits the upward motion of pushbutton 14.

FIGS. 6–9 illustrate an alternate embodiment of the invention employing diaphragm contact elements 50 having a partially cylindrical central body portion 51 and opposed tines 52 extending away from opposite ends thereof and bent downwardly in a manner similar to tines 36 of contact elements 35. Central body portion 51 is provided with crimped portions 53 along the longitudinal edges thereof which have been found to enhance the snap action of these elements. As best shown in FIG. 7, cylindrical diaphragm contact elements 50 are supported along their lower edges by the surface of support plate 30 which is apertured in a substantially identical manner to support sheet 30 of the FIG. 2 embodiment. Unlike the FIG. 2 embodiment, however, retaining sheet 60 is provided with essentially rectangular apertures 61 dimensioned to receive the cylindrical diaphragm contact elements 50 therein in the manner depicted in section in FIG. 7 in order to provide lateral restraint for these elements.

Figure 8:
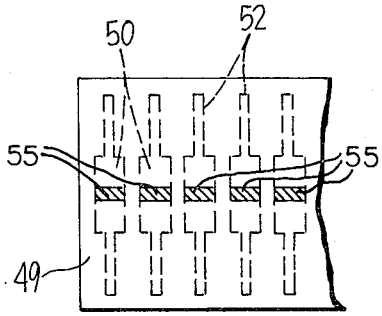
FIG. 8 is a partial top plan view of sheet stock for forming the diaphragm contact elements of the FIG. 6 embodiment.

With reference to FIG. 8, individual cylindrical diaphragm contact elements 50 are formed in a manner substantially similar to that discussed above with reference to FIG. 5 by stamping out blanks having the configuration shown in dotted outlines from a sheet of stock material 49, after which the central body portion 51 is curved by stamping in a die, the crimped portions 53 are formed therein by stamping, and the tines 52 are bent at substantially right angles in the direction shown. Initial plating of sheet stock 49 is restricted to the narrow contact region 55. Assembly and operation of the FIG. 6 keyboard proceeds in a manner substantially identical with that described above with reference to FIGS. 2–5.

Figure 10:
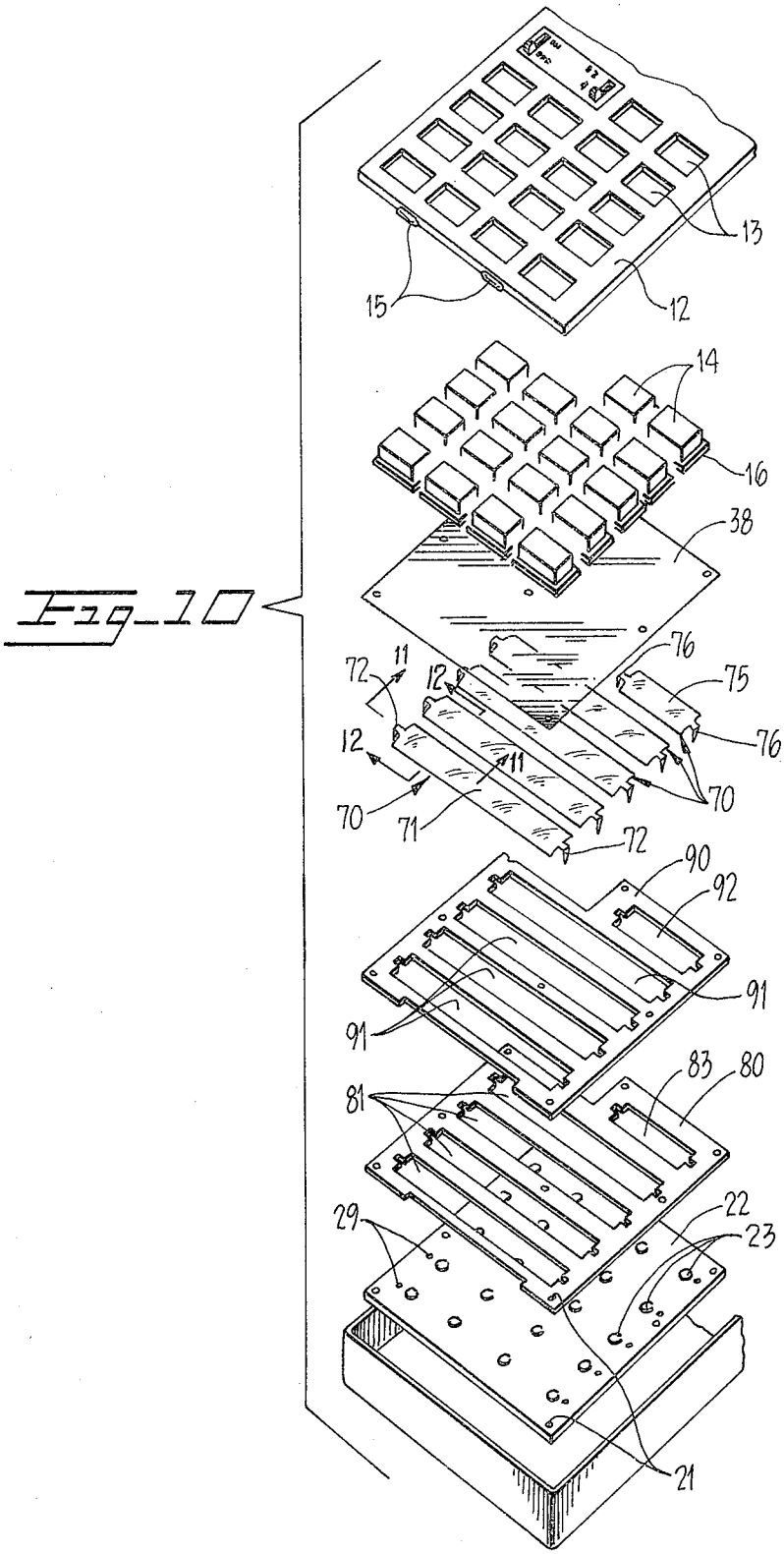
FIG. 10 is an exploded perspective view of an alternate embodiment of the invention.
Figure 11:
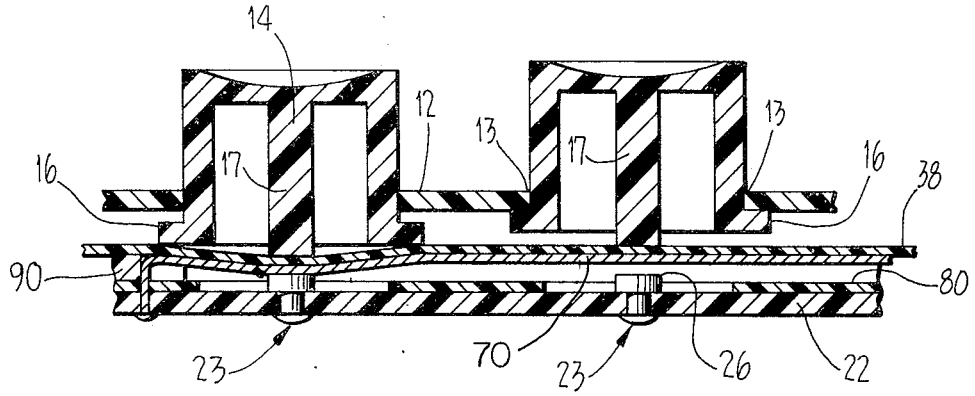
FIG. 11 is a partial sectional view taken along lines 11—11 of FIG. 10 with one pushbutton depressed.
Figure 12:
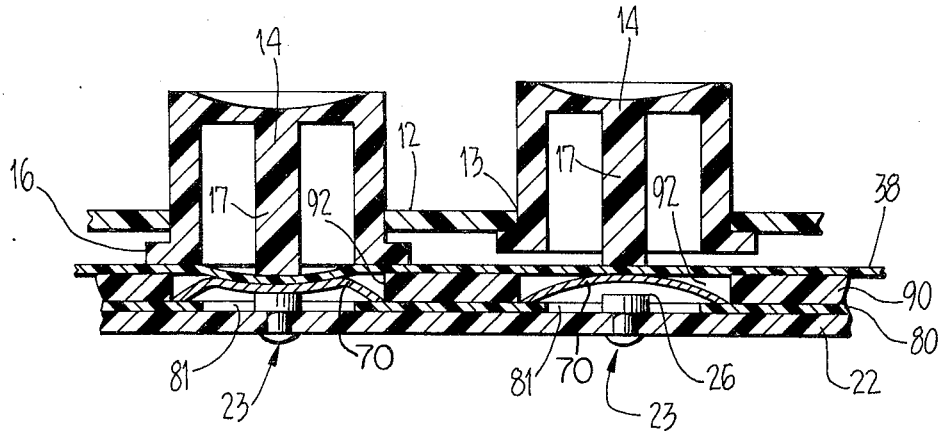
FIG. 12 is a partial sectional view taken along lines 12—12 of FIG. 10 with one pushbutton depressed.

FIGS. 10 through 12 illustrate still another embodiment of the invention in which the number of diaphragm contact elements is substantially reduced. With reference to FIG. 10, cylindrical diaphragm contact elements 70 are provided, each of which spans an entire row of four fixed contact elements 23. Each cylindrical diaphragm contact element 70 has a partially cylindrical central body portion 71 and a pair of opposing tines 72 received in a corresponding aperture at each end of a row of fixed contact elements 23. Since the uppermost horizontal row of pushbuttons 14 in the FIG. 10 embodiment employs only two pushbuttons, a shortened version 75 of the extended cylindrical diaphragm contact element 70 is employed in this row. A modified support sheet 80 is employed having extended substantially rectangular apertures 81 and a shortened rectangular aperture 83 on which the lower edges of diaphragm contact elements 70, 75, respectively rest, as well as a retaining sheet 90 having modified retaining apertures 91, 92 for receiving these elements. Assembly of the FIG. 10 embodiment proceeds in substantially the same manner as that already described above in connection with the emodiments of FIGS. 1–9.

In operation, actuation of an individual one of the pushbuttons 14 causes the associated underlying portion of cylindrical diaphragm contact element 70 or 75 to flex to make contact with the underlying head 26 of a fixed contact 23. It is noted that the extent of flexing along the longitudinal direction of the diaphragm contact element 70 is insufficient to cause contact with more than one fixed contact element 23. Upon release, the previously actuated pushbutton 14 is returned to the upright non-actuated position by the spring force caused by the flexed portion of the contact element.

Figure 13:
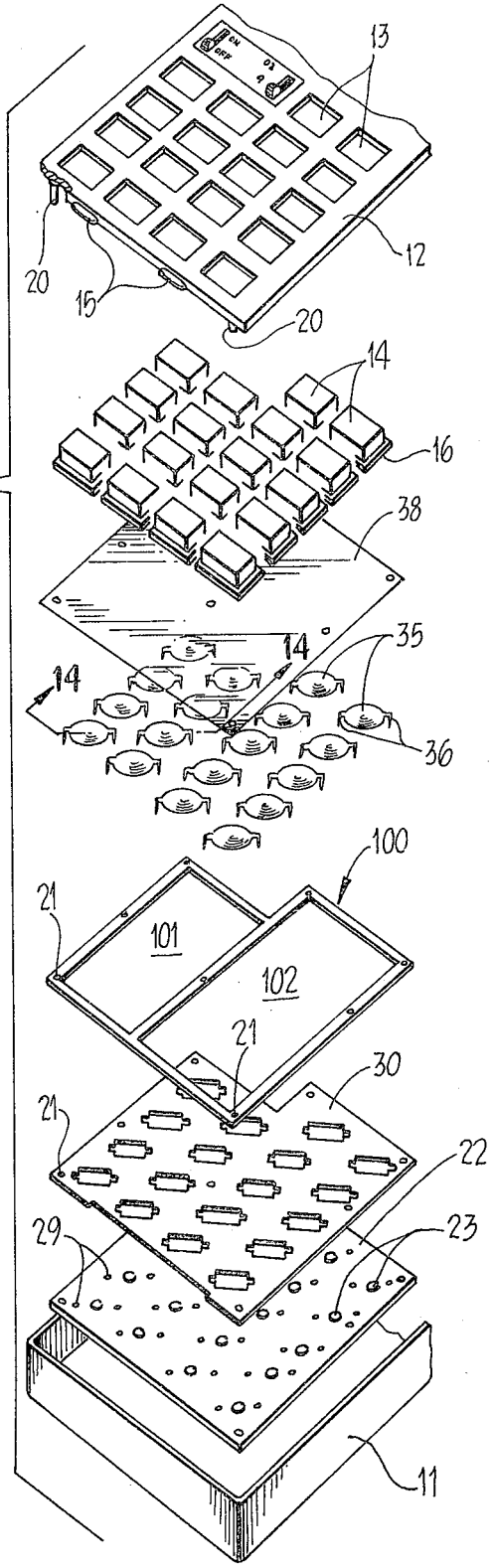
FIG. 13 is an exploded perspective view of an alternate embodiment of the invention.
Figure 14:
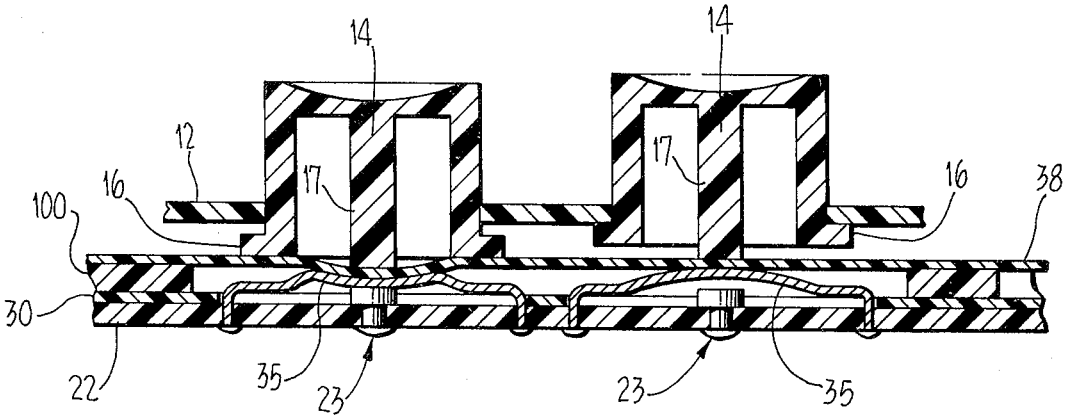
FIG. 14 is a partial sectional view taken along lines 14—14 of FIG. 13 with one pushbutton depressed.
Figure 12:
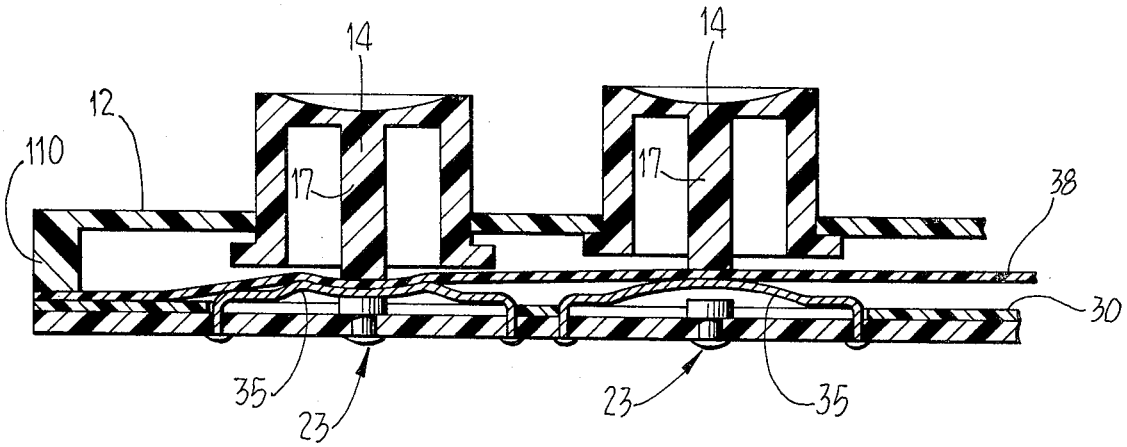

In many applications, the necessity for providing a retaining sheet for restraining lateral movement of diaphragm contact elements 35 is unnecessary. In such applications, a keyboard having the construction shown in FIGS. 13 and 14 is employed in which retaining sheet 32 is replaced by a spacer member 100 fabricated from the same type of material used to fabricate retaining sheet 32 but provided with two generally rectangular cutout portions 101, 102, arranged to expose the underlying diaphragm contact elements 35. In this embodiment, tines 36 are typically soldered to base member 22 to provide lateral stability to these elements. With reference to FIG. 14, spacer member 100 is constructed of a thickness required to position the lower end of each pushbutton spindle 17 in slight contact with the upper surface of cover sheet 38 which in turn is in contact with the upper surface of the underlying diaphragm element 35.

This embodiment provides a further advantage of reducing the resistive force to depression of a pushbutton 14 caused by that portion of cover sheet 38 overlying the associated aperture 33 in the FIG. 2 embodiment. More specifically, when a pushbutton 14 is depressed in the FIG. 2 embodiment, that portion of cover sheet 38 overlying the associated aperture 33 is forced downwardly by spindle 17 into the aperture. Since cover sheet 38 must yield over the relatively small area delineated by aperture 33, a resistive force is presented which may be undesirable in some applications. In contrast, in the FIG. 13 embodiment cover sheet 30 yields over the relatively large area delineated by aperture 101 or 102 in response to the actuation of a pushbutton resulting in a resistive force which is negligible.

Figure 16:
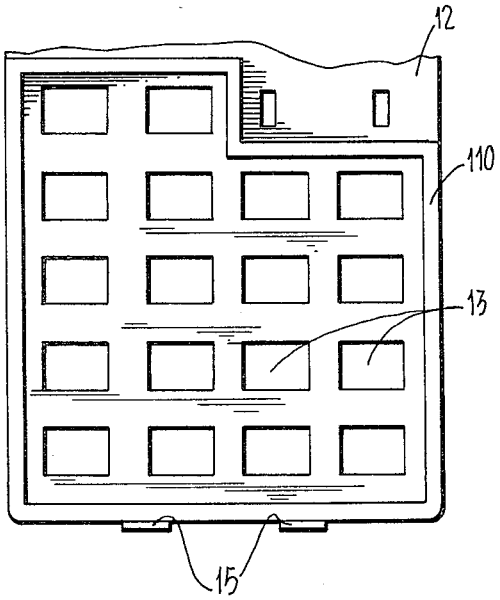
FIG. 16 is a bottom plan view of the top cover member taken along lines 16—16 of FIG. 15.
Figure 15:
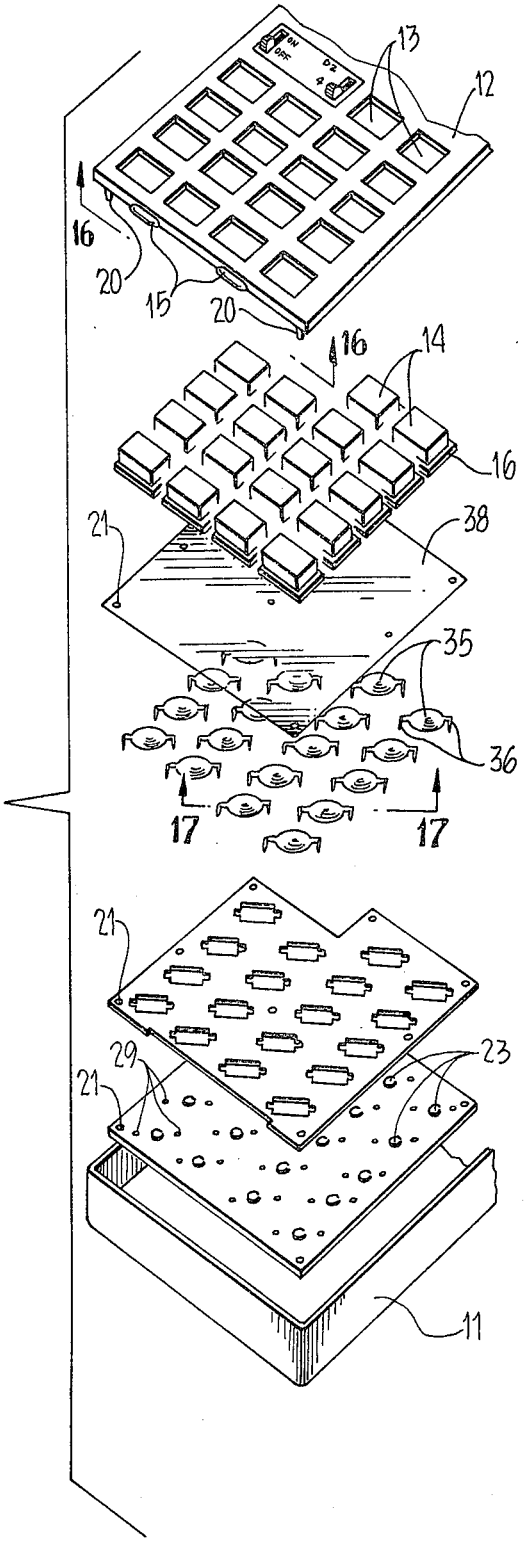
FIG. 15 is an exploded perspective view of an alternate embodiment of the invention.

FIGS. 15–17 illustrate still another embodiment having the added advantage of the FIG. 13 embodiment and in which spacer member 100 is eliminated and the spacing function is performed by a portion of top cover member 12. As best shown in FIG. 16, in this embodiment top cover member 12 is provided with a wall boundary portion 110 which projects in the direction of base member 22 and which extends peripherally around the region containing pushbutton apertures 13. As best shown in FIG. 17, cover sheet 38 is received between the lower edge of boundary wall 110 and the upper surface of support member 30 to provide the requisite dust seal for the keyboard elements. If desired, the upper surface of cover sheet 38, or the lower surface of boundary wall 110 may be provided with an adhesive to enhance the sealing action.

Keyboards constructed in accordance with the teachings of the invention can be fabricated at an extremely low cost and have been found to be durable and to enjoy a long useful product lifetime. In addition, the snap action force provided by the diaphragm contact element can be varied to meet the requirements of a given application by simply changing the curvature of the central body portion thereof, or the thickness or composition of the material. In addition, the number and configuration of pushbuttons 14 can be easily varied by selecting a diaphragm contact element of appropriate geometrical shape and spacing the various apertures in the support and retainer sheets and the arrangement of the fixed contact elements 23 in any desired fashion. Because of the individual electrical connections provided by the diaphragm contact element tines, the invention is compatible with a wide variety of switching circuit arrangements, such as individual contact addressing, or X-Y matrix addressing, as required. Further, while the invention has been dislcosed in connection with a base member 22 having electrically conductive circuit paths adhered to the bottom surface thereof, if desired these circuit paths may be provided on the upper surface to provide a single sided keyboard. Alternatively, the keyboard may be hard wired using individual insulated connectors soldered, welded, or otherwise physically and electrically connected to the individual tines of the diaphragm contact elements and the individual fixed contact elements 23.

While the above provides a full and complete disclosure of the preferred embodiments of the invention, various modifications, alternate constructions and equivalents may be employed without departing from the true spirit and scope of the invention. For example, although support sheet 30 and retainer sheet 32 have been disclosed as separate members, if desired a single sheet-like member may be provided having a set of compound apertures sized substantially identical to the retaining apertures and the apertures on the underlying support sheet and providing the same function. Therefore, the above description and illustrations should not be construed as limiting the scope of the invention, which is defined by the appended claims.

What is claimed is:

1. A keyboard assembly comprising:

an electrically insulative member having a plurality of fixed electrically conductive contact elements arranged in a predetermined pattern, each fixed contact element having a portion projecting in a first direction from said base member, said base member further including a plurality of contact regions;

an electrically insulative support sheet carried by said base member and having a plurality of apertures for receiving said projecting portions;

an electrically insulative apertured spacer member carried by said support sheet;

a plurality of movable snap action diaphragm contact elements supported by said support sheet, said diaphragm contact elements each having a pair of opposed tines extending through said support sheet and connected to said contact regions of said base member;

a plurality of actuatable pushbuttons overlying said diaphragm contact elements, each said pushbutton having a central spindle extending in a direction generally opposite said first direction and adapted to be coupled to one of said diaphragm contact elements; said apertured spacer member enabling the coupling between said spindles and said diaphragm contact elements and a top cover member having a plurality of apertures for receiving said pushbuttons.

2. The combination of claim 1 wherein said spacer member comprises a bounded wall portion of said top cover member, said wall portion projecting in the direction of said base member and extending peripherally of said pushbutton apertures.

3. The combination of claim 1 wherein said spacer member comprises a sheet having a plurality of apertures.

4. The combination of claim 3 wherein said apertures correspond in number to said support sheet apertures, said spacer sheet apertures being arranged in registry with said support sheet apertures and dimensioned to receive associated ones of said diaphragm contact elements in order to provide lateral restraint therefor.

5. The combination of claim 1 wherein said diaphragm contact elements are dome shaped.

6. The combination of claim 1 wherein said diaphragm contact elements are partially cylindrical.

7. The combination of claim 6 wherein said diaphragm contact elements are provided with crimped portions along the supporting edges thereof for enhancing the snap action thereof.

8. The combination of claim 6 wherein said diaphragm contact elements are equal in number to the number of fixed contact elements.

9. The combination of claim 1 wherein said base member contact regions comprise a plurality of apertures, and said tines are received in said base member apertures.

10. The combination of claim 1 further including a flexible protective sheet overlying said spacer member and said diaphragm contact elements.

11. A keyboard assembly comprising:

an electrically insulative base member having a plurality of fixed electrically conductive contact elements arranged in a predetermined pattern and adapted to be electrically coupled to associated circuit elements, each fixed contact element having a portion projecting in a first direction from said base member, said base member further including a plurality of contact regions;

a plurality of snap action diaphragm contact elements overlying said fixed contact elements, each said diaphragm contact element having a pair of opposed tines extending in a direction generally opposite said first direction to said base member and coupled to said contact regions;

electrical insulative means coupled to said base member for supporting said diaphragm contact elements and for limiting lateral movement thereof; and means for flexing said diaphragm contact elements to enable contact with one of said fixed contact elements to provide an electrical switching function.

12. The combination of claim 11 wherein said electrically insulative means includes a first support sheet carried by said base member and having a plurality of apertures for receiving said projecting portions of said fixed contact elements, and a retaining sheet carried by said support sheet and having a plurality of apertures corresponding in number to said support sheet apertures, said retaining sheet apertures being arranged in registry with said support sheet apertures and dimensioned to receive associated ones of said diaphragm contact elements in order to provide lateral restraint therefor.

13. The combination of claim 11 wherein said flexing means includes a plurality of actuatable pushbuttons overlying said diaphragm contact elements, each said pushbutton having a central spindle extending in a direction generally opposite said first direction and engageable with one of said diaphragm contact elements, and a top member having a plurality of apertures for receiving said pushbuttons.

14. The combination of claim 11 wherein said diaphragm contact elements are dome shaped.

15. The combination of claim 11 wherein said diaphragm contact elements are partially cylindrical.

16. The combination of claim 15 wherein said diaphragm contact elements are provided with crimped portions along the supporting edges thereof for enhancing the snap action thereof.

17. The combination of claim 15 wherein said diaphragm contact elements are equal in number to the number of fixed contact elements.

18. The combination of claim 11 wherein said base member contact regions comprise a plurality of apertures and said tines are received in said base member apertures.

19. The combination of claim 11 further including a flexible protective sheet overlying said diaphragm contact elements and said electrical insulative means.

* * * * *